US011697549B2

(12) United States Patent
Sullinger et al.

(10) Patent No.: US 11,697,549 B2
(45) **Date of Patent: *Jul. 11, 2023**

(54) FLEXIBLE CONTAINER LINER WRINGING DEVICE AND LINER

(71) Applicant: ILC DOVER IP, INC., Frederica, DE (US)

(72) Inventors: Randy R Sullinger, Columbia, MO (US); Tony R. McKee, Millsboro, DE (US); Adam Michael Sadkowski, Lincoln, DE (US)

( * ) Notice: Subject to any disclaimer, the term of this patent is extended or adjusted under 35 U.S.C. 154(b) by 625 days.

This patent is subject to a terminal disclaimer.

(21) Appl. No.: 16/528,721

(22) Filed: Aug. 1, 2019

(65) Prior Publication Data

US 2019/0352088 A1 Nov. 21, 2019

Related U.S. Application Data

(62) Division of application No. 15/244,623, filed on Aug. 23, 2016, now Pat. No. 10,822,161.

(60) Provisional application No. 62/293,599, filed on Feb. 10, 2016.

(51) Int. Cl.

| | |
|---|---|
| ***B65D 88/16*** | (2006.01) |
| ***B65D 88/54*** | (2006.01) |
| ***B65B 69/00*** | (2006.01) |
| ***B65D 90/04*** | (2006.01) |
| ***B65D 83/00*** | (2006.01) |

(52) U.S. Cl.

CPC ..... *B65D 88/1618* (2013.01); *B65B 69/005* (2013.01); *B65D 83/0055* (2013.01); *B65D 88/1631* (2013.01); *B65D 88/54* (2013.01); *B65D 90/046* (2013.01)

(58) Field of Classification Search

CPC ..... B65D 88/1618; B65D 83/0055; B65D 88/54; B65D 90/046; B65D 88/1631; B65B 69/005

USPC ..... 220/601, 495.06, 1.6; 222/100, 1

See application file for complete search history.

(56) References Cited

U.S. PATENT DOCUMENTS

| | | | | |
|---|---|---|---|---|
| 3,965,953 A * | 6/1976 | Becker | B65D 88/1612 383/6 |
| 6,427,873 B2 * | 8/2002 | Wilcox | B65D 77/06 222/386.5 |
| 9,695,545 B2 * | 7/2017 | Goble | A47L 9/00 |

* cited by examiner

*Primary Examiner* — Mollie Impink

(57) ABSTRACT

A liner L has a liner body (11) with a front wall (12), rear wall (16), bottom wall (13), a top wall (14). The top wall also includes a tubular excess liner material or chute (19) located close to the rear wall and which includes a filling fitment (20) with a fitment cap (21). The liner also has a cylindrical, hose content inlet/outlet port or bottom fitment (23). The liner may include a gap-filler or filler strip (70) of foam material extending outwardly from a position closely adjacent the outlet fitment. The filler strip is mounted to the front wall directly over and closely adjacent the outlet fitment. The filler strip may taper so that at least a majority of the strip's longitudinal length or height so as to increase in its lateral width as it approaches the outlet fitment, thereby increasing the material volume of strip material.

9 Claims, 10 Drawing Sheets

FLEXIBLE CONTAINER LINER WRINGING DEVICE AND LINER

REFERENCE TO RELATED APPLICATION

This is a divisional patent application of U.S. patent application Ser. No. 15/244,623 filed Aug. 23, 2016 which claims the benefit of U.S. Provisional Patent Application Ser. No. 62/293,599 filed Feb. 10, 2016.

TECHNICAL FIELD

This invention relates to bulk container liners which utilize devices to extract the material contents from the liner through the wringing of the liner.

BACKGROUND OF THE INVENTION

Flexible liners are oftentimes utilized in conjunction with an intermediate bulk containers which are typically 42 to inches is length, width and height, to ship large quantities of liquid, viscous or granular products. A problem long associated with the use of such liners has been the complete or near-complete evacuation of the contents from within the liner. As such, some liners have utilized pressurized regions to lift or angle the bottom of the liner or to move the interior sidewalls inwardly so as to move the contents closer to the outlet of the liner. While these devices have aided in the evacuation of the liner they can still result in rather large quantities of content remaining within the liner. This type of container also requires the use of additional pressurizing equipment to pressurize the inflatable regions.

Liners have also been designed with only a centrally located top fitment so that a vacuum hose head may be positioned within the top fitment to vacuum out the contents of the liner. A problem associated with this type of liner has been that as the contents are evacuated the liner material oftentimes folds and contacts another portion of the liner, thereby blocking the evacuation path. As such, an unacceptable amount of content material may again remain within the liner.

Accordingly, it is seen that a need remains for a device to aid with a more efficient evacuation the liner's contents, especially those used with intermediate bulk containers and a liner which works in conjunction with such as device. It is to the provision of such therefore that the present invention is primarily directed.

SUMMARY OF THE INVENTION

A liner for use with an intermediate bulk material container. The liner comprises a liner body having a top wall, a bottom wall, and a plurality of side walls extending between the top wall and the bottom wall. The liner also has an outlet fitment coupled to one side wall of the plurality of side walls, and a filler strip coupled to one side wall of the plurality of side walls. The filler strip is a length of flexible material extending from a position adjacent the bottom wall towards the top wall.

DETAILED DESCRIPTION

Figure 1:
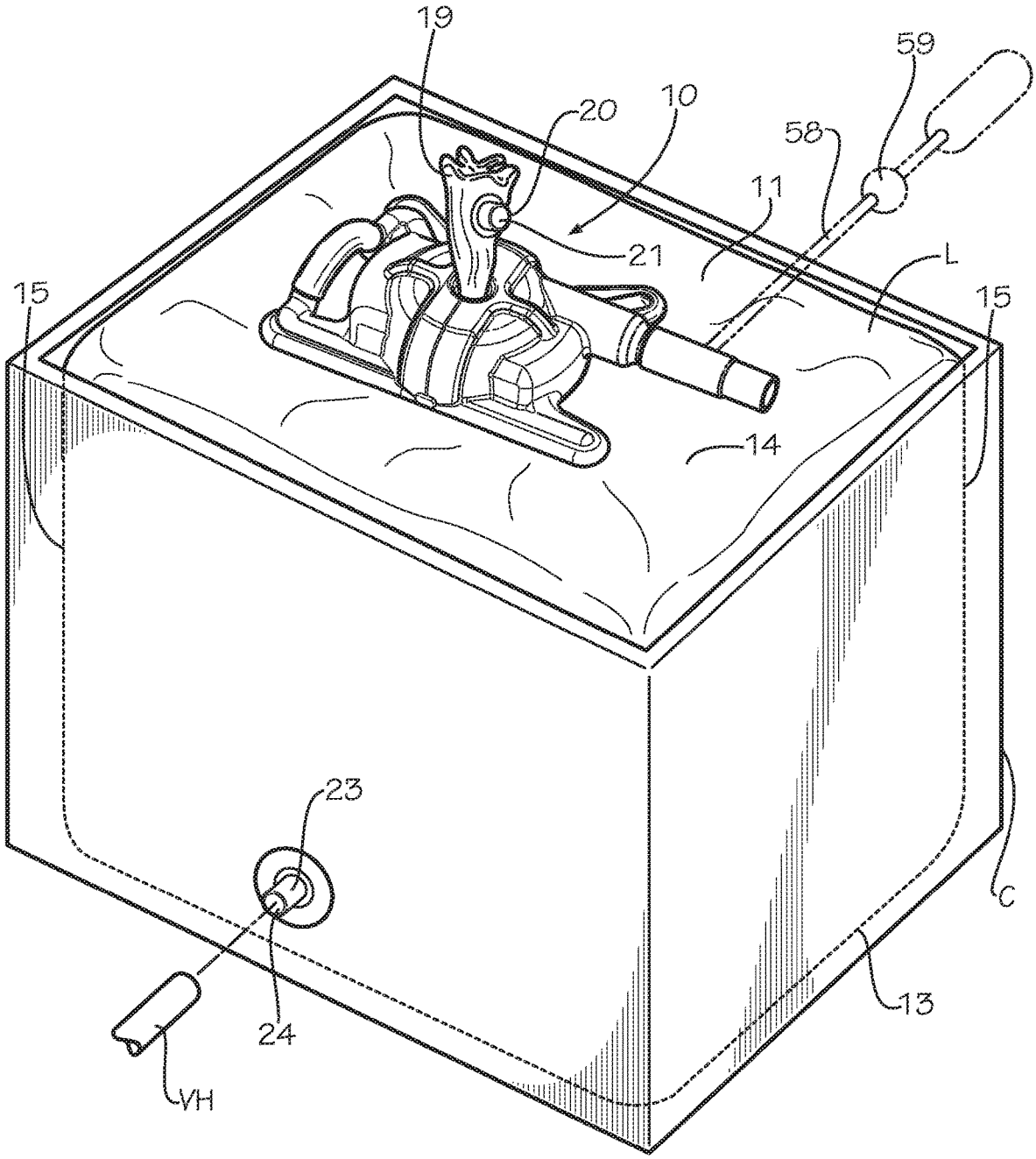
FIG. 1 is a perspective view of a liner wringing device embodying principles of the invention in a preferred form, shown coupled to a liner and liner container.
Figure 2:
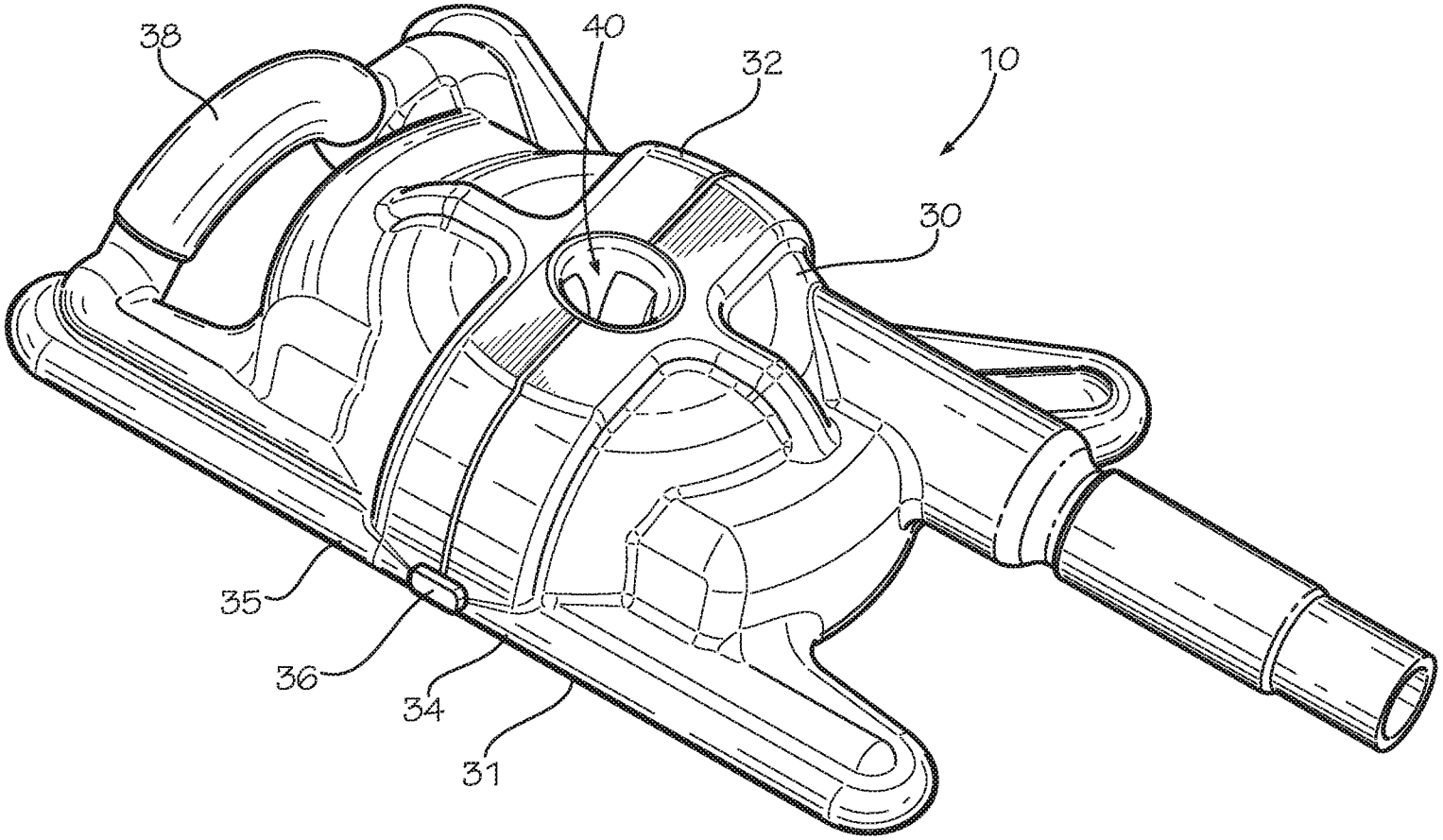
FIG. 2 is a perspective view of the liner wringing device of FIG. 1.
Figure 3:
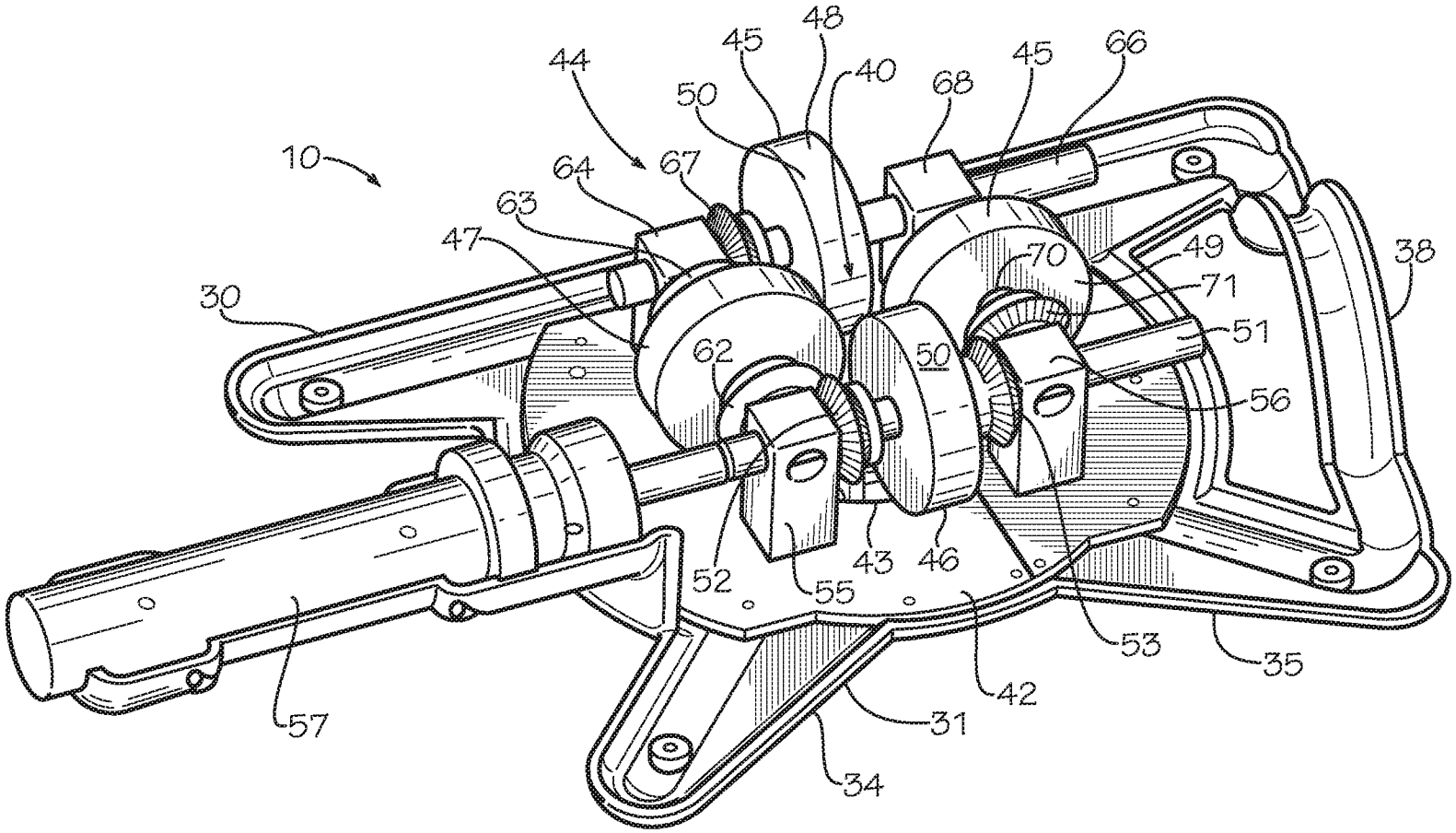
FIG. 3 is a perspective view of the liner wringing device of FIG. 1, shown with a top portion of the housing removed.
Figure 4:
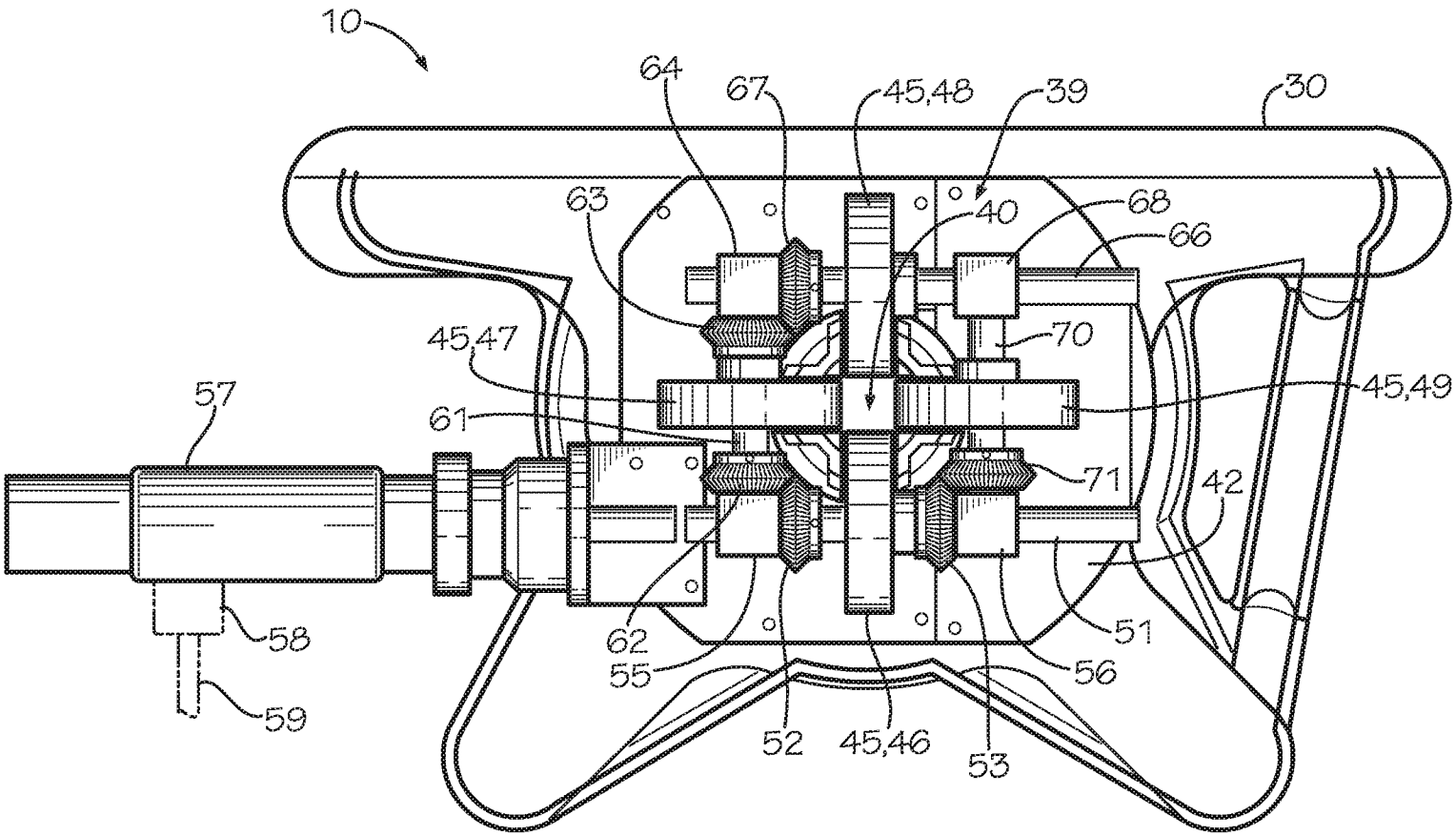
FIG. 4 is a top view of the liner wringing device of FIG. 1, shown with a top portion of the housing removed.

With reference next to the drawings, there is shown a flexible container liner wringing device 10 embodying principles of the invention in a preferred form. The wringing device 10 is configured to be used in conjunction with a flexible container or liner L positioned within a container C, which is preferably in the form of a rigid intermediate bulk container but which may also be in the form of a flexible bag or a semi-rigid container.

The liner L has a liner body 11 with a front wall 12, rear wall 16, bottom wall 13, a top wall 14 and end or side walls 15, however, the front wall, rear wall and end walls may be considered to be one tubular side wall in the form of four peripheral side walls extending between the bottom wall and top wall so as to define a generally box shape configuration. The top wall 14 also includes a tubular excess liner material or chute 19 located close to the rear wall 16 and which includes a filling fitment 20 with a fitment cap 21. The liner L also has a cylindrical, hose content inlet/outlet port or bottom fitment 23, having a fitment cap 24, which extends through the liner bottom wall 13 or side wall 15 adjacent the bottom wall. A vacuum hose VH may be coupled to the bottom fitment in fluid communication with the interior space of the liner to aid in the extraction of the material within the liner.

The liner's box shape can be described generally as a rectangular prism, although it should be understood that due to the nature of flexible materials the walls follow the shape of the container. Furthermore, flexibility of the plastic material enables the walls to collapse during dispensing without interference. The liner body may be made of a plastic sheet or film material such as a polyethylene film.

The wringing device 10 includes an exterior shell or housing 30 having a bottom half 31 and a top half 32 which define an internal cavity or compartment 39 which houses the internal mechanical components of the wringing device 10. The housing is also divided between a motor portion 34 and a handle portion 35 which are removably coupled to each other though a pair of latches 36 which enable the motor portion 34 to be moved away from or separated from the handle portion. The housing motor portion 34 forms a handle 38. The housing 30 also defines a central liner compression hole, pathway or channel 40 partially defined by both the motor portion and the handle portion through which the liner passes during initial use of the wringing device 10. The housing 30 has a metal bottom support plate 42, which may be considered part of the housing and central liner compression channel 40, coupled to the housing bottom half 31 for mounting the mechanical components described hereinafter. The bottom support plate is also divided into a motor portion associated with the motor portion of the housing and a handle portion associated with the handle portion of the housing. The bottom support plate includes a substantially enclosed central opening 43 aligned along the central channel 40.

The wringing device 10 internal mechanical components are utilized to draw the liner L through the wringing device 10 thereby forcing the material or contents within the liner towards the bottom of the liner, or more precisely, to move the wringing device downwardly along the emptied or wrung portion of the liner as the material is extracted, thereby maintaining the material within the bottom portion of the liner. The mechanical components include a drive assembly 44 formed by four elastomeric rollers 45, such as neoprene rollers, positioned so that the outer or peripheral contact surfaces 50 of the rollers are aligned generally vertically to and tangentially with, adjacent to, or along the central channel 40, i.e., the four rollers are each positioned so that the outer circumference or contact surface 50 of the roller is vertically positioned along the central channel 40 so that they each contact and engage a portion of the liner as it passes through the central pathway. The four rollers 45 are oriented in a cross or + shaped configuration so that both pairs of oppositely disposed rollers squeeze the liner there between, which prevents the material from being squeezed sideways within the liner thereby avoiding being squeezed downwardly. In other words, the first roller is generally axially parallel to the oppositely disposed third roller, while the second roller is generally axially parallel to the oppositely disposed fourth roller, with the first and third rollers being generally axially perpendicular to the second and fourth rollers. Opposite pairs of rollers may be considered to be pairs of generally axially parallel aligned rollers. The term axially parallel and axially perpendicular is intended to mean an alignment with reference to an imaginary line extending along the axis of the roller or generally along the drive shaft/axle supporting the roller.

The four rollers 45 consist of a first roller 46, a second roller 47, a third roller 48 and a fourth roller 49. The first roller 46 is mounted to a first drive shaft/axle 51 which also includes a first bevel gear 52 and a second bevel gear 53. The first drive shaft/axle 51 is mounted to the bottom support plate 42 through a first roller support block 55 and a second roller support block 56, through which the first drive shaft/axle 51 is journalled. The end of the first drive shaft/axle 51 is coupled to a pneumatic air gear motor 57 which rotatably drives the first drive shaft/axle 51. The pneumatic air gear motor 57 is coupled to a source of pressurized air through a pressure line 58 and pressure regulator 59. The pneumatic air gear motor 57 may be a Ingersoll-Rand model number #41007RVR188BR6 with a starting torque of 76.5 lg/ft, a stall torque of 102 lb/ft, a speed max power of 47 rpm, and a max air consumption of 33 scfm.

The second roller 47 is mounted to a second drive shaft/axle 61 which also includes a third bevel gear 62 and a fourth bevel gear 63 and is rotatably coupled to a third roller shaft support block 64. The third bevel gear 62 is configured to mesh with the first bevel gear 52 of the first drive shaft/axle 51 so that rotation of the first bevel gear 52 drives the rotation of the third bevel gear 62, which in turn rotates the fourth bevel gear 63, the second drive shaft 61, and the associated second roller 47.

The third roller 48 is mounted to a third drive shaft/axle 66 which also includes a fifth bevel gear 67 and is rotatably coupled to a fourth roller shaft support block 68 and the first roller shaft support block 55. The fifth bevel gear 67 is configured to mesh with the fourth bevel gear 63 so that rotation of the fourth bevel gear 63 drives the rotation of the fifth bevel gear 67, which in turn drives the rotation of the third drive shaft 66 and the associated third roller 48.

The fourth roller 49 is mounted to a fourth drive shaft/axle 70 which also includes a sixth bevel gear 71 and is rotatably coupled to the second and fourth roller shaft support blocks 56 and 68. The sixth bevel gear 71 is configured to mesh with the second bevel gear 53 so that rotation of the second bevel gear 53 drives the rotation of the sixth bevel gear 71, which in turn drives the rotation of the fourth drive shaft/axle 70 and the associated fourth roller 49.

Thus, the first, second, third and fourth drive shafts are linked together for simultaneous rotational movement through their respective bevel gears with rotation of the first drive shaft which is forcible driven through the actuation of the pneumatic air gear motor 57. This simultaneous rotation of the four drive shafts transfers or translates to similar simultaneous rotational movement of the four rollers 45 coupled to the drive shafts. The placement and configuration of the bevel gears enables each of the four rollers 45 to rotate at the same speed in an upward direction (synchronic motion) at a location tangential to the central channel 40.

Figure 5:
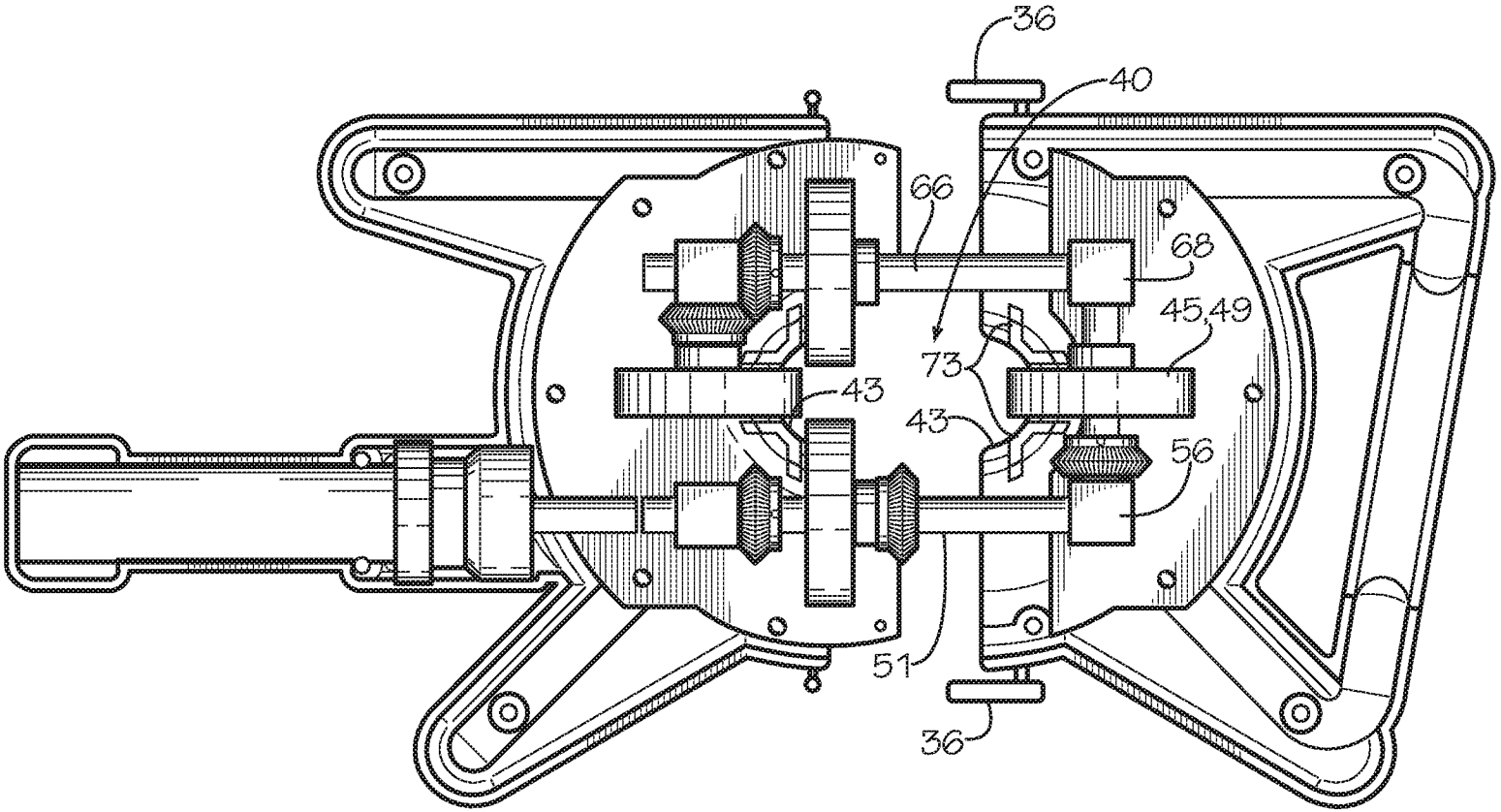
FIG. 5 is a top view of the liner wringing device of FIG. 1, shown in a separated configuration.

It should be understood that one of more of the drive shafts may be coupled to an in-line latching mechanism, such as latches 36, which when opened disengages and moves one of the drive shafts or rollers outwardly to facilitate the passage of the top filling fitment 20 and chute 19 through the central channel 40 during initial placement of the liner through the wringing device 10. As shown in FIG. 5, the in-line latching mechanism is preferably associated with and for movement of the fourth drive shaft/axle 70 as the second and fourth support blocks, 56 and 68 respectively, associated with the fourth drive shaft/axle 70 are mounted to the bottom support plate of the handle portion 35 so that these support blocks may slide along the extended length of the first and third drive shaft/axles shown in the drawings. As a safety measure, the in-line latching mechanism may prevent the airline to the air gear motor 57 from being attached when in an unlatched position.

The wringing device 10 also includes four curved guide or glide blocks 73, each of which is positioned between and adjacent to each pair of adjacent rollers. The ends of the glide blocks 73 are positioned close to the roller to aid in ensuring proper alignment of the roller and to prevent the gathering of the liner between adjacent rollers during use.

Figure 6:
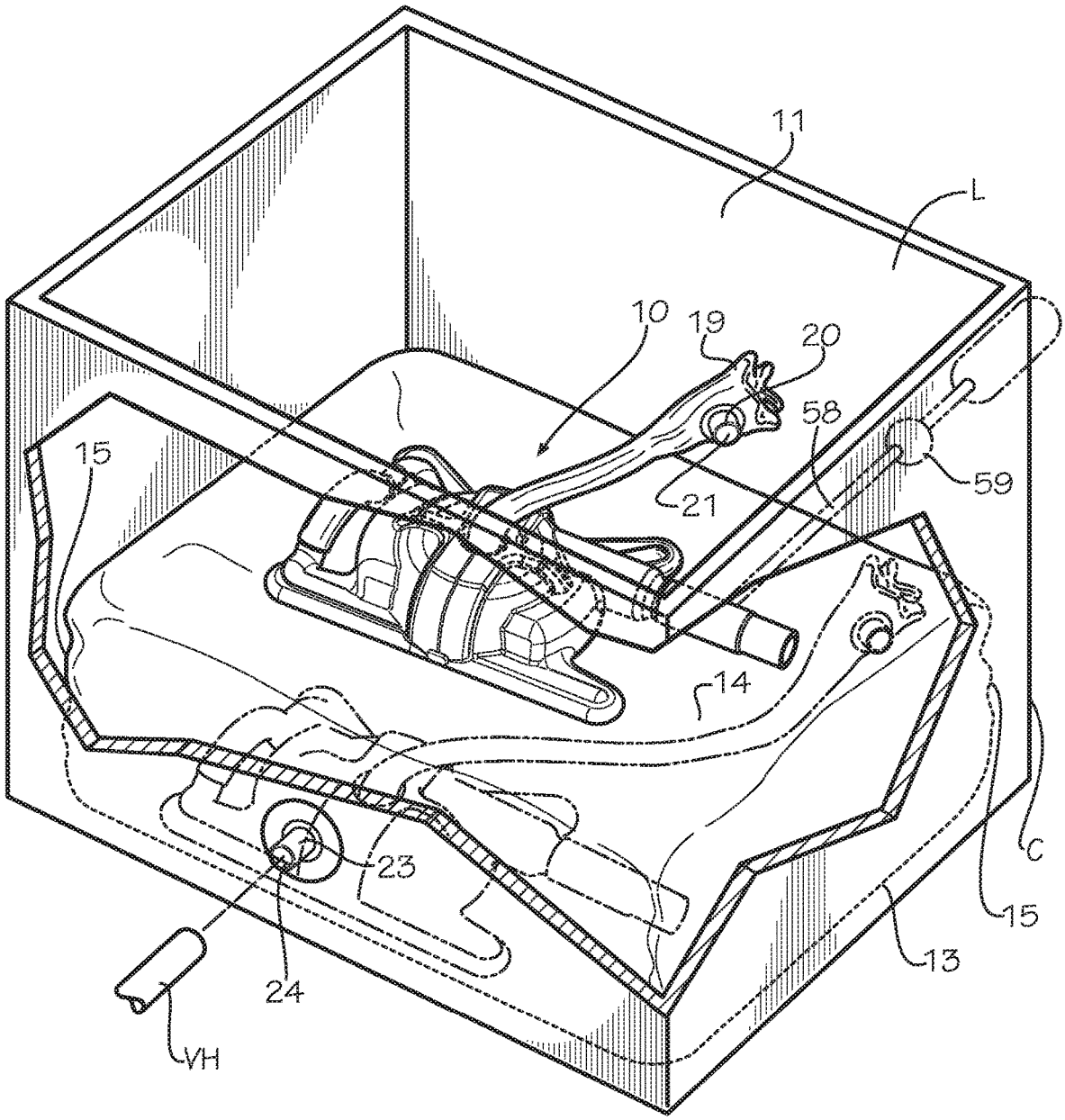
FIG. 6 is a perspective view of the liner wringing device of FIG. 1 shown partially emptied and fully emptied in phantom lines.

In use, the chute or liner spout 19 and top filling fitment 20 are passed through the central channel 40 of the wringing device 10 until the wringing device 10 rests upon the top wall 14 of the liner, as shown in FIG. 1. The housing latches 36 may be unlatched to allow limited separation between the motor portion 34 and the handle portion 35 to allow the fourth drive shaft/axle to be moved to increase the size of the central liner compression channel 40 and opening during initial mounting of the liner, as shown in FIG. 5, i.e., the fourth roller and fourth drive shaft axle is movable between a first portion close to the opening and fully closed central liner compression channel and a second position distal the opening and fully closed central compression channel. The motor portion and handle portion are returned to their latched position once the liner is properly positioned but prior to actuation of the air gear motor 57. The compressed air is then provided to the pneumatic air gear motor 57 through pressure line 58 and regulator 59, the wringing device 10 is thus turned on when the pressurized air is supplied to the air gear motor. With the actuation of the wringing device 10 the air gear motor 57 rotates the first drive shaft/axle 51, which through the meshing of bevel gears causes the mutual rotation of the second, third, and fourth drive shafts/axles 61, 66, and 70. The rotation of the four drive shafts, in turn, results in the simultaneous rotation of the four rollers 46, 47, 48 and 49 in an upward direction tangentially along the central channel and against the liner therein. The rotation of the rollers causes the liner to be frictionally engaged by the rollers so that it is pulled upwardly through the central liner compression channel 40, thereby driving the wringing device 10 downwardly against the filled portion of the liner, as shown in FIG. 6 which illustrates a liner which is approximately half evacuated. The downward movement of the device causes the liner to be forced against the confining central liner compression channel 40 thereby squeezing the liner and forcing the liner content downwardly as the device moves along the length (height) of the liner, i.e., the central liner compression channel squeezes or wrings the liner as it passes therethrough. Because of the confined space of the central channel and the squeezing action of the rollers upon the liner as it passes between the rollers, the material within the liner approaching the wringing device 10 is forced downwardly along the un-wrung portion of the liner resulting in the near complete evacuation of material from the wrung portion, as shown in phantom lines in FIG. 6.

Should the wringing device 10 sense or fail to overcome a predetermined level of resistance or pulling of the liner, the air gear motor automatically deactivates or stalls to stop the rotation of the rollers. This stalling may occur when the evacuation of the liner contents ceases or slows to a certain level for any reason. This may be accomplished through the regulation of the air pressure level supplied to the air gear motor, as the air gear motor simply provides a select amount of torque upon the rollers commensurate with the air pressure supplied to it, i.e., when the resistance provide by the liner upon the rollers reaches a certain level which cannot overcome the roller torque the air gear motor simply stops or stalls until the liner tension on the rollers reaches a level below the roller torque level of the air gear motor and the roller rotation resumes. The liner tension reduces as material is discharged from the liner through the bottom fitment 23 and the liner thereby loosens or relaxes.

As the contents of the liner are expelled through the bottom fitment 23, either by gravity or by a vacuum, the wringing device 10 continually draws the excess liner through the central liner compression channel 40 through rotation of the four rollers. The gathering and compression of the liner through the central liner compression channel and the four direction gathering and compressing or squeezing action of the four rollers upon the liner passing through the central channel 40 ensures a near complete evacuation of the liner as any residual material clinging to the liner is forced downward as it approaches the four rollers. Once the wringing device has reached the end of the liner, the liner may pass completely through the central channel or the latch is opened and the roller drive shaft disengaged to allow the liner to pass completely through the central channel. Once the liner passes completely through the wringing device 10 very little material should remain within the liner as the material has been pushed downwardly and through the bottom fitment.

As an alternative, the liner may be voided of all but the last residual material prior to activating the wringing device. This also decreases the pressure at which the motor operates as it does not have to expel the material to such a large degree.

It should be understood that the just described wringing device 10 provides for a device which is easily portable and removable so that it may be moved between different devices easily and quickly.

It should be understood that the term central, as in central or compression channel, is not intended to denote an exact location in the center and is instead intended to denote a channel that is located within the confines of a periphery. Also, it should be understood that the central channel and/or central opening 43 are considered substantially "enclosed" as they do not include a gap which is large enough for a portion of the liner to become entrapped within the gap. As such, even though the support plate and housing are actually divided, the openings or channels therein are considered to be substantially enclosed.

It should also be understood that the numeric terms used herein, such as first, second, third, etc., are intended for reference to the drawings and may not represent the exact same elements numerically contained or enumerated within the claims.

Figure 15:
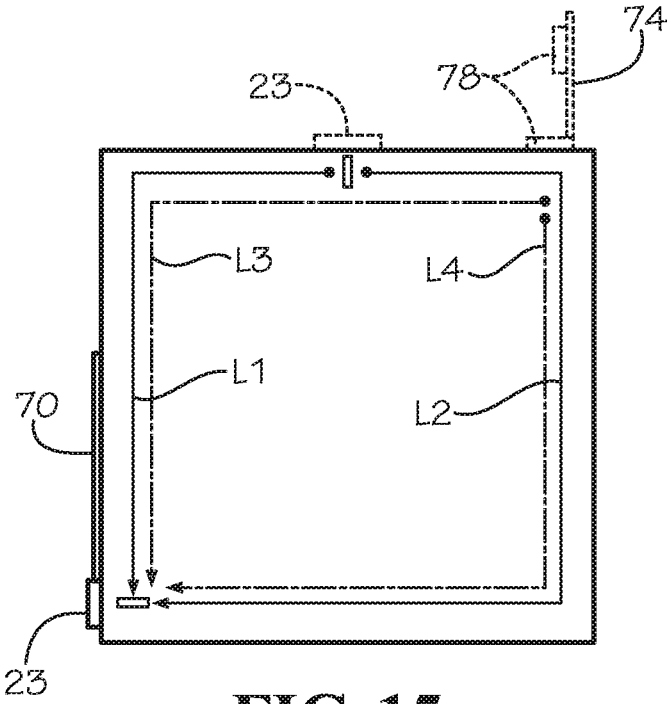
FIG. 15 is a schematic side view of the liner of FIG. 13.

It should be noted that the liner may be made of a material having a somewhat tacky exterior surface, such as from a film of metallocene resin, to maximize the gripping effect or pulling on the rollers upon the liner. The liner may also be made of different thicknesses of material. For example, the front wall 12, bottom wall 13, top wall 14 and back wall may be made of a 4 mil, 2 ply material while the side walls 15 are made of a 3.2 mil, 2 ply material. The difference in the wall thicknesses aid in maintaining a constant pull of the liner through the wringing device by decreasing the wall thickness as the amount of liner material increases through the wringing device, i.e., to compensate for a larger amount of material (more square inches of material) passing through the wringing device the thickness of the material decreases to maintain a desired total amount or volume of material passing therethrough. The increase in material amount (more square inches) is a result of the geometry of the liner wherein more material is present within the wringing device as the middle portion of the liner passes through the wringing device compared to the corners or corner adjacent areas of the liner passing through the wringing device, as shown in FIG. 15 and described in more detail hereinafter.

Figure 7:
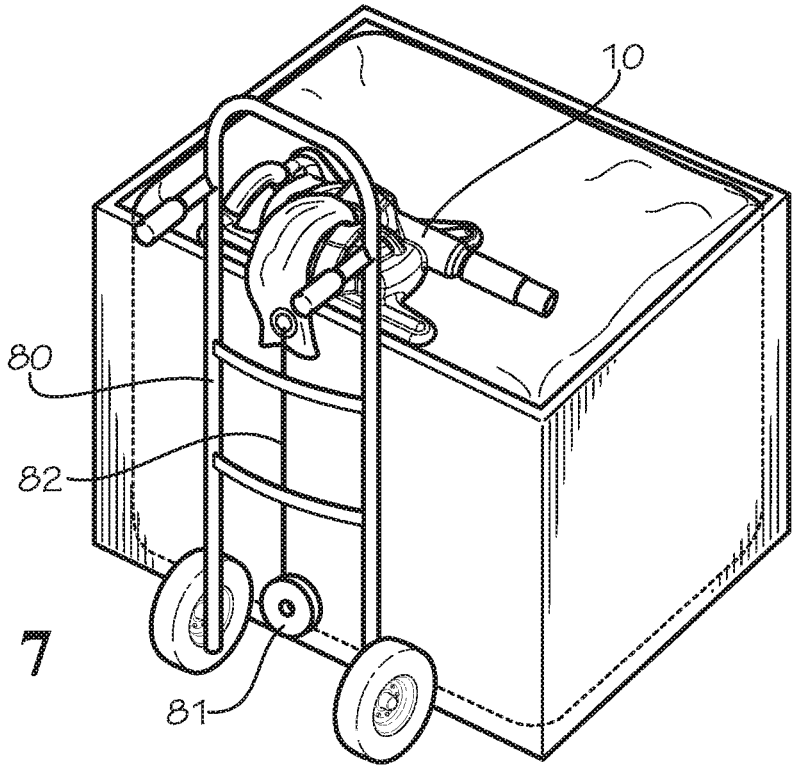
FIGS. 7-10 are a series of view of a liner within a container being emptied by a wringing device.
Figure 8:
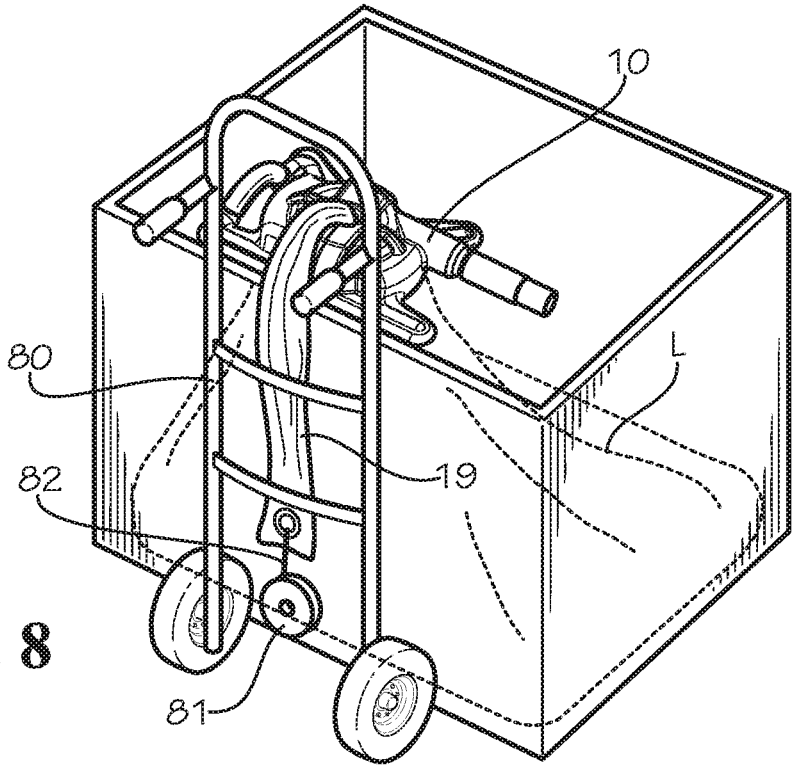
Figure 9:
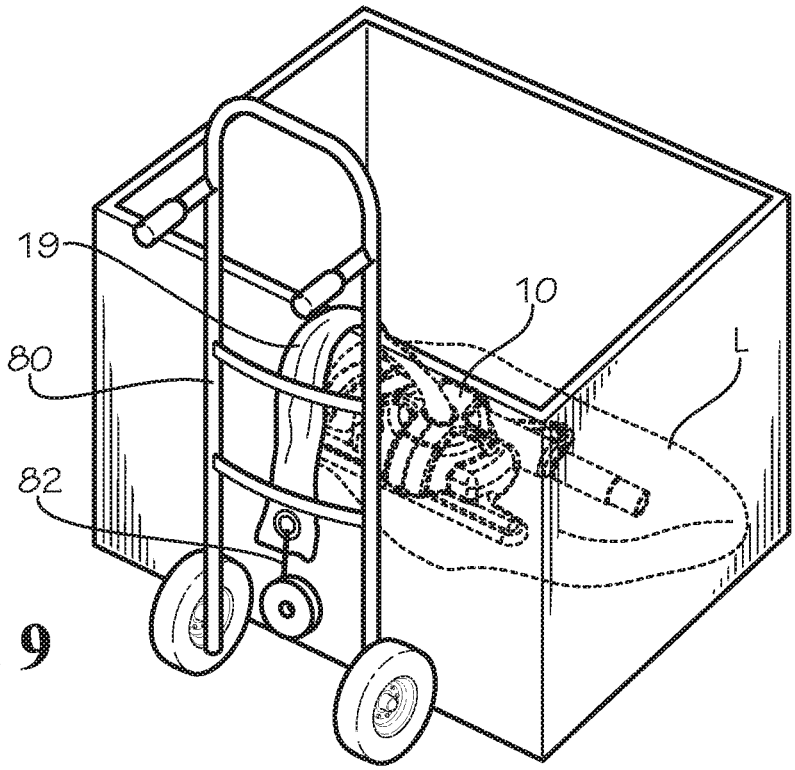
Figure 10:
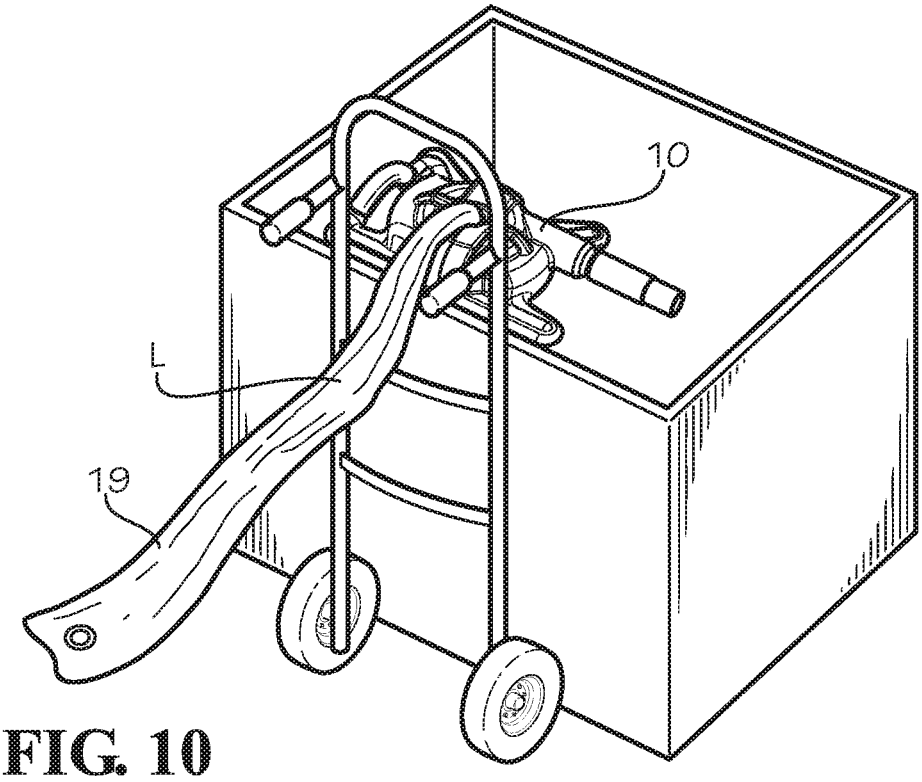
Figure 11:
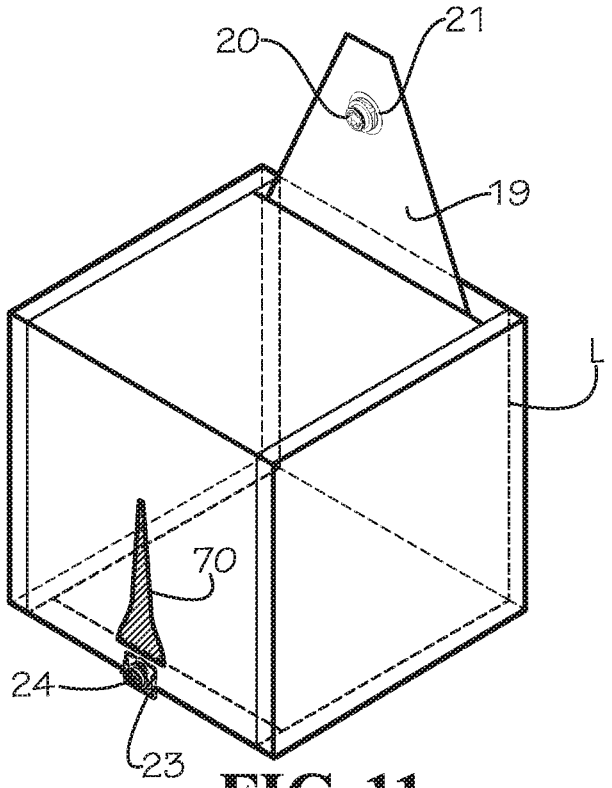
FIG. 11 is a perspective view of the liner shown in FIGS. 7-10.
Figure 12:
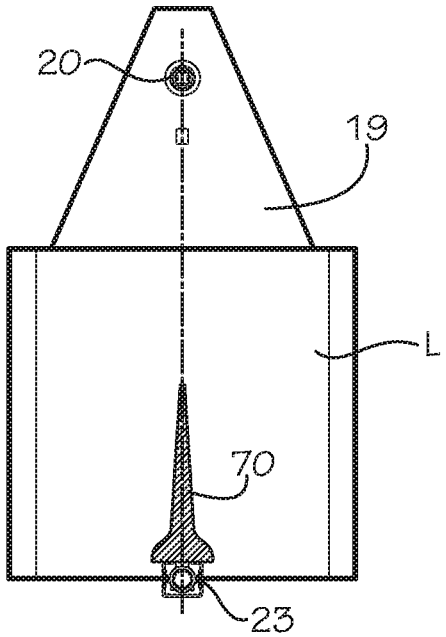
FIG. 12 is a front end view of the liner of FIG. 11.

As shown in FIGS. 7-10, the wringing device may be mounted to a portable hand truck 80. The hand truck 80 is pushed into position engaging the container, as seen in FIG. 7. A constant pull pulling or tensioning device 81 having a tensioning cable 82 is coupled to the chute 19 to provide an even pull upon the chute as the liner contents are emptied, see FIGS. 8-9. Once the liner is emptied, the wringing device is remounted upon the hand truck 80, as shown in FIG. 10.

With reference next to the liner L itself, the liner has unique features which enable it to be better utilized with a wringing device.

The liner L may include a gap-filler or filler strip 70 of foam material extending outwardly from a position closely adjacent the outlet fitment. The filler strip may be a 1.2 pound/foot, closed cell polyethylene material, which acts to provide material volume when the liner is in a compressed or gathered condition. The filler strip 70 is mounted, preferably by adhesive, to the front wall 12 directly over and closely adjacent the outlet fitment 23. The filler strip 70 may taper so that at least a majority of the strip's longitudinal length or height so as to increase in its lateral width as it approaches the outlet fitment 23 (extends from the top wall towards the bottom wall), thereby increasing the material volume of strip material. The purpose of the filler strip 70 is to provide bulk or additional material volume to this portion of the liner so that the amount or volume of material passing through the wringing device does not significantly decrease as the wringing device approaches the outlet fitment 23 at the conclusion of the wringing process. A significant decrease in material volume could cause the wringing device to slip upon the liner and thereby prevent the liner from being pulled through the wringing device.

Figure 13:
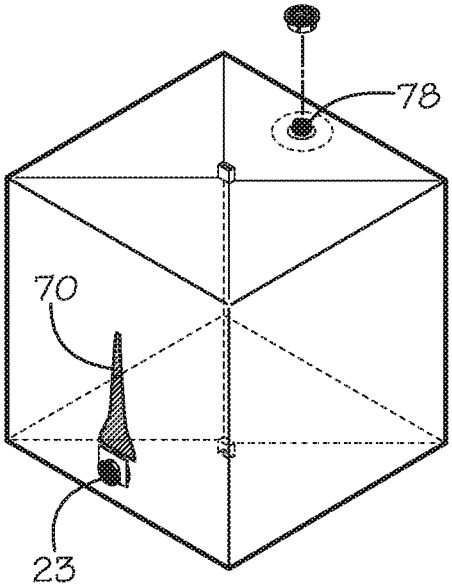
FIG. 13 is perspective view of the liner in another preferred embodiment.
Figure 14:
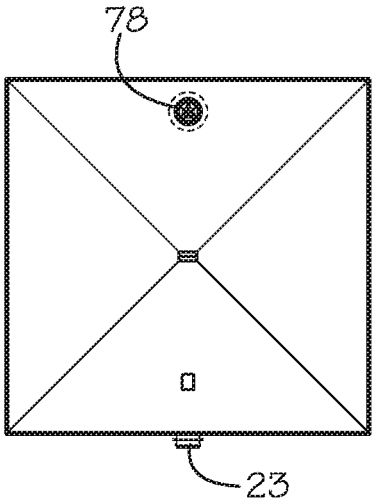
FIG. 14 is a top view of the liner of FIG. 13.

As shown in FIGS. 13-15, the liner L may also include a top fitment 78 which is located on the top wall 14 close to or adjacent the rear wall 16, either by itself or in conjunction with a chute 74 at this position. The purpose of the rearward location of the fitment 78 or chute 74 is to improve the geometry of the liner and the resulting pulling through the wringing device. As best shown in FIG. 15, with the fitment 20 in a central location the "run" or the length of material from the fitment 20 to the outlet fitment 23 along the front side of the liner is length L1. This length is much shorter than the run or length of material from a centrally mounted fitment 20 to the outlet fitment 23 along the backside of the liner is length L2. This difference in length causes the front side of the liner to be pulled through the wringing device long prior to the backside of the liner being pulled through. This results in excess material along the backside of the liner not being pulled completely through the wringing device. It has been discovered that by placing the fitment 78 adjacent the rear wall 16 the front run or length L3 is essentially equal to the rear run or length L4. As the run length of material (L3 and L4) are generally equivalent, both lengths pass through and finish through the wringing device at essentially the same time.

It should also be understood that the outlet fitment 23 may be designed to include a thin layer of plastic or the like to seal the fitment. The plastic seal may be perforated by the connector or hose configured to mate with the outlet fitment to allow the flow of contents from the line.

It should be understood that the liner body 23 may be of any conventional construction, such as that shown in the preferred embodiment, a gusseted design, a pillow design, or a tapered design sometimes referred to in the industry as a bottleneck design.

It thus is seen that a liner design to allow for a device for extracting material from inside a liner is now provided which overcomes problems associated with such devices of the prior art. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A liner for use with an intermediate bulk material container, said liner comprising, a liner body having a top wall, a bottom wall, and a plurality of side walls extending between said top wall and said bottom wall;

an outlet fitment coupled to a first said side wall of said plurality of side walls, and a material volume increasing gap-filler coupled to said first side wall of said plurality of side walls in a position above said outlet fitment, said material volume increasing gap-filler being a length of flexible foam material extending from a position adjacent said bottom wall towards said top wall, said material volume increasing gap-filler being coupled to said liner along its entire length.

2. The liner of claim 1 wherein said foam material is a closed cell polyethylene material.

3. The liner of claim 1 wherein said plurality of side walls includes a front wall, wherein said outlet fitment is mounted to said front wall, and wherein said material volume increasing gap-filler is coupled to said front wall.

4. The liner of claim 3 wherein said material volume increasing gap-filler extends from a position directly over and closely adjacent said outlet fitment towards said top wall.

5. A liner for use with an intermediate bulk material container, said liner comprising, a liner body having a generally rectangular prism configuration;

an outlet fitment coupled to said liner body, and a material volume increasing gap-filler coupled to said liner body, said material volume increasing gap-filler being a length of flexible material having one end mounted directly to said liner body at a position adjacent and above said outlet fitment and an opposite end mounted directly to said liner body at a position distally and above said outlet fitment.

6. The liner of claim 5 wherein said material volume increasing gap-filler is a foam material.

7. The liner of claim 6 wherein said foam material is a closed cell polyethylene material.

8. The liner of claim 5 wherein said liner body includes a front wall, wherein said outlet fitment is mounted to said front wall, and wherein said material volume increasing gap-filler is also coupled to said front wall.

9. The liner of claim 8 wherein said material volume increasing gap-filler extends from a position directly over and closely adjacent said outlet fitment towards a top wall.

* * * * *